US009434896B2

(12) United States Patent
Hannemann et al.

(10) Patent No.: US 9,434,896 B2
(45) Date of Patent: Sep. 6, 2016

(54) DUST SEPARATION FROM THE CRUDE GAS OF AN ENTRAINED FLOW GASIFIER

(71) Applicant: SIEMENS AKTIENGESELLSCHAFT, München (DE)

(72) Inventors: Frank Hannemann, Freiberg (DE); Manfred Schingnitz, Freiberg (DE)

(73) Assignee: SIEMENS AKTIENGESELLSCHAFT (DE)

( * ) Notice: Subject to any disclaimer, the term of this patent is extended or adjusted under 35 U.S.C. 154(b) by 223 days.

(21) Appl. No.: 14/449,508

(22) Filed: Aug. 1, 2014

(65) Prior Publication Data

US 2015/0033627 A1 Feb. 5, 2015

(30) Foreign Application Priority Data

Aug. 1, 2013 (DE) ..... 10 2013 215 120

(51) Int. Cl.

| | |
|---|---|
| ***B01J 7/00*** | (2006.01) |
| ***C10J 3/84*** | (2006.01) |
| ***C10K 1/10*** | (2006.01) |
| *C10J 3/48* | (2006.01) |

(52) U.S. Cl.

CPC ..... *C10J 3/84* (2013.01); *C10K 1/101* (2013.01); *C10J 3/485* (2013.01); *C10J 2300/093* (2013.01)

(58) Field of Classification Search

CPC ..... C10J 3/84; C10J 3/466; C10J 3/485; C10J 3/506; C10K 1/101

See application file for complete search history.

(56) References Cited

U.S. PATENT DOCUMENTS

| | | | | |
|---|---|---|---|---|
| 5,453,115 | A * | 9/1995 | Vuletic | B01D 47/10 95/186 |
| 2007/0044381 | A1 | 3/2007 | Holle et al. | |
| 2011/0146485 | A1* | 6/2011 | Kang | B01D 47/06 95/22 |
| 2013/0303636 | A1* | 11/2013 | Schmitt | C10C 1/00 518/702 |
| 2014/0224636 | A1* | 8/2014 | Shah | C10L 5/04 201/3 |
| 2015/0041720 | A1* | 2/2015 | Zhang | C10K 1/02 252/373 |

FOREIGN PATENT DOCUMENTS

| | | | |
|---|---|---|---|
| DE | 4446803 | C2 | 5/1998 |
| DE | 19718131 | C2 | 10/1999 |
| DE | 102005041930 | A1 | 3/2007 |
| EP | 0677567 | B1 | 9/1997 |

OTHER PUBLICATIONS

Carl J. et al: Noell-Konversionsverfahren zur Verwertung und Entsorgung von Abfällen, EF-Verlag für Energie-und Umwelttechnik GmbH, pp. 25-53, 1994.

* cited by examiner

*Primary Examiner* — Imran Akram

(74) *Attorney, Agent, or Firm* — Ostroelnk Faber LLP

(57) ABSTRACT

A multistage gas washing system is applied for dust separation from crude gases of entrained flow gasification of pulverized fuels under pressures up to 10 MPa and temperatures which are greater than the melting point of the fuel ash. A first stage comprises a modified quenching system and a downstream washing column, which operates as a bubble column. A second washing stage comprises one or more Venturi washers connected in series. A third washing stage comprises multiple high-pressure atomization units of washing water, a partial condenser for cooling the crude gas by 1 to 15° C. with condensate formation, and a separation column, which is equipped with washing surfaces and a plastic-coated demister.

14 Claims, 3 Drawing Sheets

DUST SEPARATION FROM THE CRUDE GAS OF AN ENTRAINED FLOW GASIFIER

CROSS-REFERENCE TO RELATED APPLICATIONS

The present application claims the priority of German Patent Application No. 102013215120.9, filed Aug. 1, 2013, the contents of which are incorporated by reference herein.

TECHNICAL FIELD

The invention relates to a multistage crude gas washing system having a high degree of separation of particles, in particular fine dust, during the production of crude gas rich in CO and $H_2$ in an entrained flow gasification plant by reaction of ash, but also slag-forming fuels, under pressures up to 10 MPa and temperatures up to 1900° C.

TECHNICAL BACKGROUND

Pulverized fuels are understood to include finely-ground coals of different degrees of carbonization, dusts made of biomasses, products of the thermal pretreatment such as coke, dried products by way of "torrefaction", and fractions having high calorific value from municipal and industrial residual materials and waste materials. The pulverized fuels can be supplied as a gas-solid suspension or as a liquid-solid suspension to the gasification. The gasification reactors can be provided with a cooling screen or with a refractory lining, as disclosed in the patents DE 4446803 and EP 0677567. According to various systems introduced into technology, the crude gas and the molten liquid slag can be discharged separately or jointly in this case from the reaction chamber of the gasification device, as described in DE 19718131. A comprehensive description of the overall technology is found in J. Carl, P. Fritz, NOELL-KONVERSATIONSVERFAHREN, EF-Verlag, 1996, pages 25-53. Entrained flow gasification causes, as a result of the fuel particles, which are ground as fine as dust, and shorter reaction times in the gasification chamber, an increased dust fraction in the crude gas. This flue dust consists, in dependence on the reactivity of the fuel, of carbon black, unreacted fuel particles, and fine particles of slag and ash. The size varies between coarse particles having a diameter greater than 0.5 mm and fine particles having a diameter up to 0.1 μm. The separability of the particles from the crude gas is dependent on this diameter, but also on the composition thereof. Fundamentally, a differentiation can be made between carbon black and ash, on the one hand, and slag particles, on the other hand, wherein carbon black particles are generally smaller and more difficult to separate from the crude gas. Slag particles have a higher density and therefore a better separability, but in contrast thereto have a higher hardness and therefore an erosive effect. This results in increased wear in the classifying separators and lines which conduct crude gas, which can cause safety-relevant leaks and service life restrictions.

The previous prior art is documented in the patent DE 10 2005 041 930 and also in "Die Veredelung von Kohle [The Refinement of Coals]", DGMK, Hamburg, December 2008, chapter "GSP-Verfahren [GSP Method]" pages 537-553, particularly in FIGS. 4.4.2.4.13 and 4.4.2.9.1. Accordingly, the gasification crude gas leaves the gasification chamber jointly with the slag formed from the fuel ash at temperatures of 1300-1900° C. and is cooled in a downstream quenching chamber by injection of excess water and freed of the slag and, to a small extent, of entrained dust. The further dust removal is performed in two Venturi washers connected in series, wherein the second washer has an adjustable throat to be able to keep the velocity in the throat constant even in the event of changing crude gas quantity and therefore to ensure a uniform velocity for the entrained dust. The gas purification was conceived for dust quantities up to 2 g/m$^3$ under normal conditions and is intended to achieve a dust quantity of 1-3 mg/m$^3$ under normal conditions at the outlet, which is necessary for disturbance-free operation of the downstream plants, such as CO conversion, synthesis, or gas turbines. To remove fine dusts, particularly of salt spray, a partial condenser is operated, in which the crude gas is cooled by 1-15° C., wherein the condensed water precipitates on the salt particles in particular and is removed from the crude gas stream by separation of the water droplets. For dust quantities greater than 2 g/m$^3$ under normal conditions, this arrangement consisting of two Venturi washers and a partial condensation step is only partially adequate or is inadequate and can result in substantially higher dust concentrations in the intake of the CO conversion and also increased erosion in the Venturi washers and furthermore in soiling and blocking in the partial condenser and the downstream systems.

SUMMARY OF THE INVENTION

Proceeding from this prior art, it is the object of the invention to provide a gas purification system for an entrained flow gasification plant, which has a high separation rate of particles, in particular of fine dust, which, with a reliable operating mode, takes into consideration the different ash contents and ash properties of the fuels, and which has a high availability.

This object is achieved by a crude gas washing system having the features of the first invention.

To design the gasification plant for higher dust concentrations, consisting of coarse and fine particles, a selective separation of the particles is used. A combination of coarse-fine separators is proposed, which, in a first purification step, separates the coarse and particularly erosive particles in a robust and possibly multistage washing stage. This firstly has a quenching chamber, into which excess water is injected in finely dispersed form and in which, in addition to the cooling of the crude gas, a separation of very coarse dust particles occurs simultaneously. This is assisted by the arrangement of a hood over the crude gas discharge, which, in conjunction with a partition wall protruding downwards into the hood, forces the gas stream into a triple direction change and is additionally sprayed to avoid incrustations. Subsequently, the crude gas flows through a washing column having an immersion pipe, where it rises upward as a bubble column in the accumulated washing liquid. Due to the low velocity in the gas chamber located above it, dust-loaded water droplets are not entrained and fall back into the bubble column. All particles >10 μm are completely separated via this purification step. Smaller particles are separated in a following purification step, which consists of one or two successive Venturi washers. To also separate ultrafine particles <1 μm, the crude gas experiences direct cooling, but also indirect cooling of 1-15° C. by high-pressure injection of water 18, 20 or in a heat exchanger 19, respectively. The water loaded with fine dust and also condensate is subsequently separated from the crude gas in a fine droplet separator and returns into the water circuits. Ultrafine droplets having a large surface area, which can also absorb very fine particles, arise due to the high-pressure injection and the cooling. The fine droplet separator 21 can be equipped with washing surfaces 22 and is fitted in the top part with a coated demister packing 23. To counteract the hazard due to soiling of the droplet separator, it is coated using PTFE or a Teflon compound. Over 99.9% of the particles can be separated by the described combination of the mentioned cleaning stages.

BRIEF DESCRIPTION OF THE DRAWINGS

The invention will be explained hereafter to an extent required for understanding on the basis of three figures and three exemplary embodiments. In the figures.

DESCRIPTION OF EMBODIMENTS

In the figures, identical reference signs identify identical elements.

Figure 1:
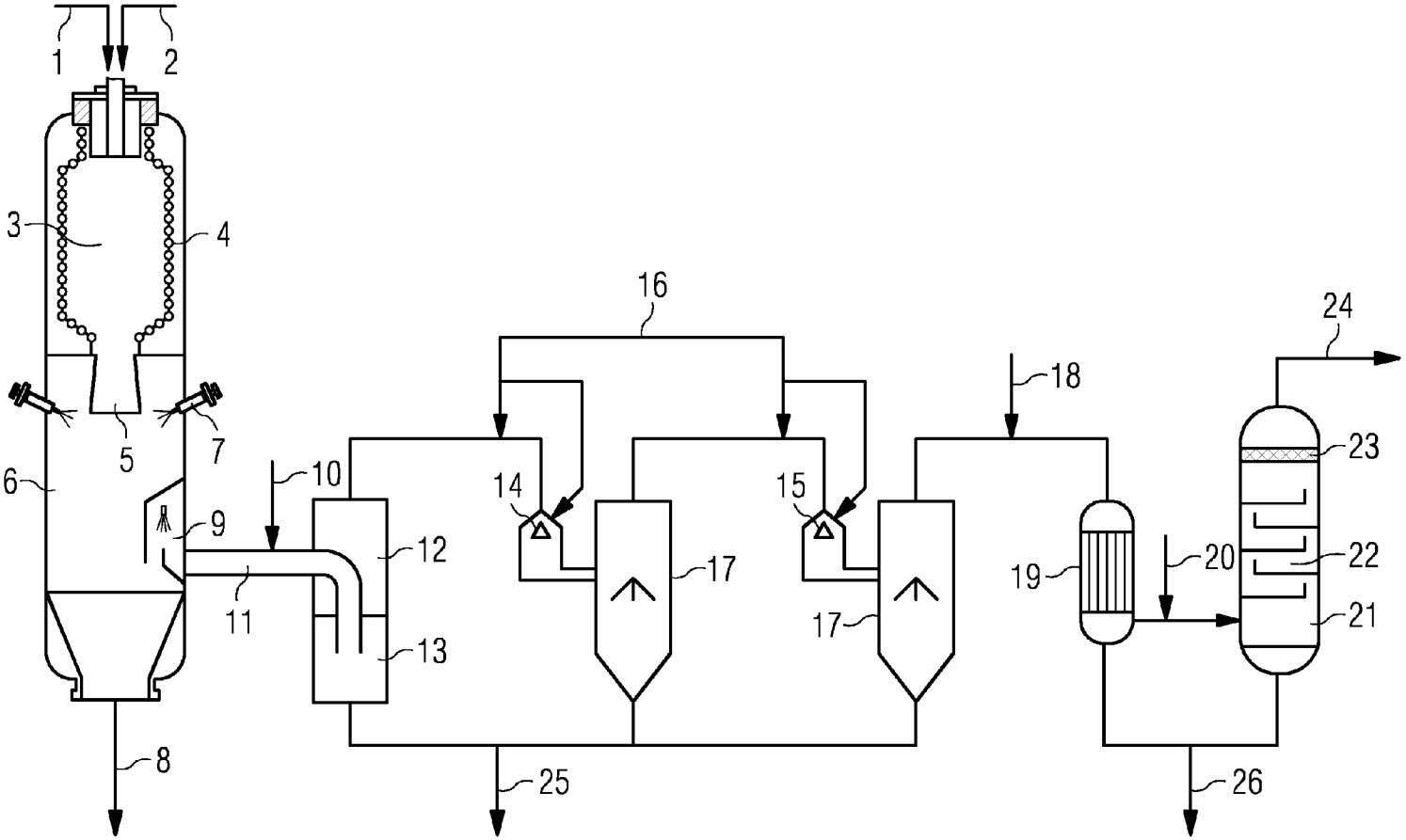
FIG. 1 shows a technology for dust separation in a cascade of quenching unit having hood, a washing column, two Venturi washers, a high-pressure injection nozzle, a partial condenser, and a fine droplet separator.

80 Mg/h pulverized dust made of a lean coal are supplied to an entrained flow reactor having a gross output of 500 MW, as shown in FIG. 1, according to the principle of pneumatic conveying using carbon dioxide as a carrier gas via the dust conveyor line 1 and converted jointly with 45,000 $m^3$/h oxygen under normal conditions via line 2 in the gasification chamber 3 at temperatures of 1650° C. and a pressure of 4.5 MPa into a crude synthesis gas. The gasification chamber 3 is delimited by a cooling screen 4. The fuel ash is melted at the mentioned gasification temperatures and largely applied to the cooling screen, runs downward, and reaches the downstream quenching chamber 6 via the crude gas and slag discharge opening 5. The crude gas quantity is 135,000 $m^3$/h under normal conditions. The temperatures after the quenching are between 150 and 250° C., the crude gas is saturated with water vapor. Not all of the fuel ash melted into slag reaches the cooling screen 4, but rather a part is discharged directly with the crude gas stream, so that the crude gas entrains a dust content of approximately 2 g/$m^3$ under normal conditions, having the following grain size distribution:

| particle size in μm | mass fraction in mass-% | total mass-% |
|---|---|---|
| 0.2 | 98.3 | approx. 35 |
| 0.25 | 95.9 | |
| 0.315 | 92.4 | |
| 0.4 | 87.4 | |
| 0.5 | 79.7 | |
| 0.63 | 65.7 | approx. 35 |
| 0.8 | 49.7 | |
| 1 | 40.6 | |
| 1.25 | 35.6 | |
| 1.6 | 33.6 | |
| 2 | 32.2 | |
| 2.5 | 31.2 | |
| 5 | 30.7 | |

-continued

| particle size in μm | mass fraction in mass-% | total mass-% |
|---|---|---|
| 10 | 30.5 | approx. 30 |
| 16 | 30.2 | |
| 50 | 30 | |
| 100 | 25.9 | |
| 400 | 21.1 | |
| 1000 | 4.4 | |
| 2500 | 0 | |

Since this dust results in disturbances in subsequent processes by way of erosion or deposits, a removal down to residual contents <1 mg/$m^3$ under normal conditions is necessary, wherein the fine dust separation represents a special technological demand. To fulfill the stated goal, a multistage gas washing system is installed. The first stage comprises a modified quenching system and a downstream washing column, which operates as a bubble column. In the quenching chamber 6, crude gas and slag are firstly cooled to 220° C. and saturated with water vapor at the same time by injection of excess water. The separation of coarse dust already begins here due to a special modification of the quenching chamber 6. For this purpose, a hood having nozzles 9 is installed over the crude gas discharge 11, wherein a partition plate protrudes from below into the space enclosed by the hood. The crude gas leaving the quencher is forced into a triple direction change, whereby a further separation of particles occurs in conjunction with the nozzles 9. The hood can be drawn over a part or the entire circumference of the quenching chamber. Additional washing water can be introduced after the crude gas discharge 11 via an injection nozzle 10. Furthermore, the crude gas enters a washing column 12, is immersed in the water bath 13, and is guided upward as a bubble column into a free space at low crude gas velocity. In this first gas washing stage, approximately 30 mass-% of the coarse dust in the grain size range from 2500 to 10 μm is removed from the crude gas.

The second washing stage comprises a Venturi washing system, in which a first Venturi washer 14 having a fixed throat and a second Venturi washer 15 having a variable throat and water supply 16 are arranged.

The variable throat in the second Venturi washer 15 enables it to react to varying crude gas quantities. In this second washing stage, approximately 35 mass-% of the dust entrained in the crude gas in a grain size range up to 0.6 μm is separated.

In the third washing stage, the demanding fine dust separation is managed, which places special demands on the technology. For this purpose, solid-free washing water is injected in ultrafine dispersed form before and after a partial condenser 19 by high-pressure injection nozzles 18 and 20, to wet the entrained dust particles. The partial condenser 19 has the same task, in which, by way of cooling of the crude gas saturated with water vapor by 1 to 15° C., approximately 3 to 10 $m^3$/h water vapor are formed with formation of similarly ultrafine droplets, wherein the fine dust particles represent condensation seeds for the water vapor and therefore the fine dust is incorporated in the condensed water. To separate the dust-carrying droplets, the third washing stage is terminated by a separation column 21, which is fitted with a plate column 22 and a plastic-coated demister 23. The crude gas, which is substantially freed of dust, leaves the separation chamber 21 via the gas discharge 24 and subsequently reaches further processes up to the generation of the final product. The carbon black water 25 separated from all of the washing stages and also the condensate and washing water 26 are returned after a separation of the entrained solids in the circuit back into the washing stages.

Figure 2:
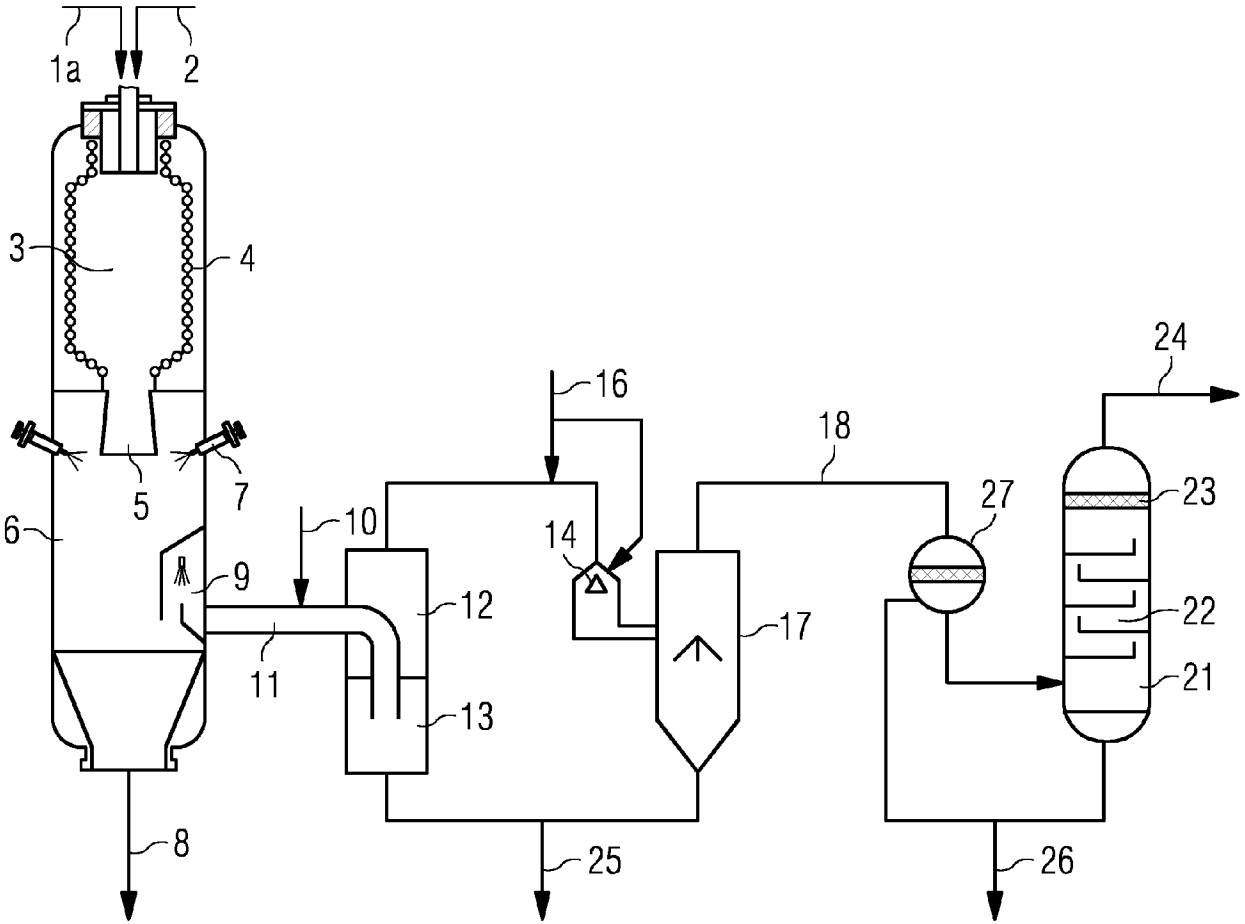
FIG. 2 shows a technology for dust separation in a cascade of quenching unit having hood, a washing column, two Venturi washers, a high-pressure atomization unit having demister-droplet separator, and downstream fine droplet separator.

In an entrained flow gasification plant according to FIG. 2, the dust fraction formed in the gasification chamber 3 during the gasification of the fuel is dependent on various parameters. These include fuel properties, such as its reactivity, the grain size distribution, the ash content, the ash composition and therefore the ash melting point, and also the toughness behavior of the slag formed. The three-stage washing system is modified in consideration of special fuel properties. In this example—having the same output as above—a water-fuel suspension having a solid fraction of 60 mass-% is supplied to the gasification reactor via the slurry line 1*a* and converted with oxygen via line 2 in the gasification chamber 3 to form crude gas. The oxygen usage is increased to 53,000 $m^3$/h under normal conditions by the entrained water fraction. The gasification temperature is 1550° C., and the pressure is 4.5 MPa. A crude gas quantity corresponding to the predefined output of 135,000 $m^3$/h is also generated under normal conditions. The first washing stage is identical to that in the above example according to FIG. 1. The second washing stage is restricted to one Venturi washer 14 having water supply 16 and a water separator 17. The Venturi washer 14 is expediently equipped with a variable throat for adaptation to occurring variations of the generated crude gas quantity. A high-pressure atomization unit 18 having a droplet separator 27 as a demister follows after the washing water separator 17, as the third washing stage, from which an additional separation column 21 is connected downstream, which is also equipped with a plate column 22 and a further plastic-coated demister. The carbon black water discharge and also the condensate and washing water discharge 25 and 26, respectively, are incorporated in the water treatment and circulation systems.

Figure 3:
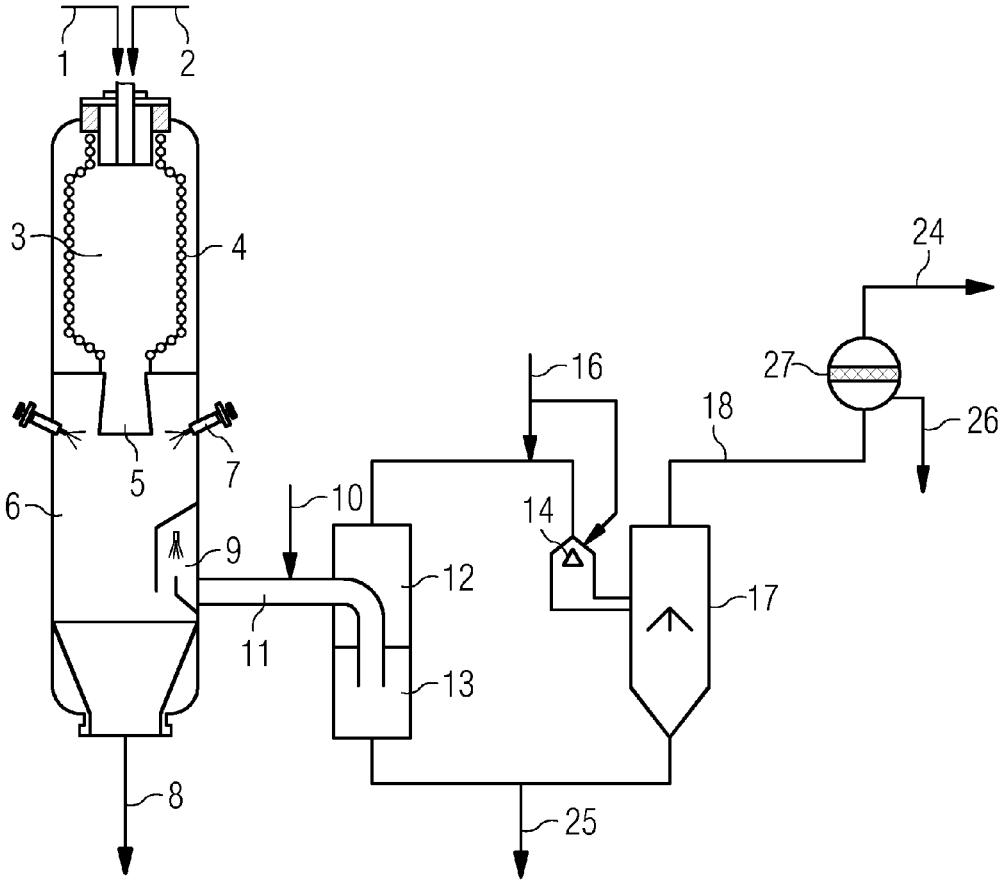
FIG. 3 shows a technology for dust separation in a cascade of quenching unit having hood, a washing column, a Venturi washer, and a high-pressure atomization unit having a demister-droplet separator.

In an entrained flow gasification plant according to FIG. 3, a water-fuel suspension is also gasified under the same conditions as in the above example. The first and second washing stages correspond to the illustration in the above exemplary embodiment according to FIG. 2. The third washing stage is restricted to the high-pressure atomization of washing water 18 and the droplet separator 27 embodied as a demister. To condense out water vapor, the washing water used in the high-pressure atomization unit 18 is used with quantities and temperatures such that the crude gas experiences a cooling by 1 to 15° C. Carbon black water 25 and condensate and washing water 26 are also incorporated into the water treatment and circulation systems.

The invention is also provided by a method for dust separation from crude gases of entrained flow gasification of pneumatically or hydraulically supplied pulverized fuels under pressures up to 10 MPa and temperatures between 150 and 250° C. in the state of water-vapor saturation by a three-stage gas washing system, in which the first stage consists of a quenching system, in which a water-sprinkled hood having nozzles 9 is arranged over the crude gas discharge 11, followed by a washing column 12, which has a water bath 13 in the bottom part, through which crude gas flows in the form of a bubble column, the second washing stage consists of one or more Venturi washers 17, which are connected in series and have downstream separators 17, the third washing stage consists of a partial condenser 19, before and after which high-pressure atomization units 18 and 20 are arranged, and a separation column 21, which has a plate column 22 and a plastic-coated demister 23.

LIST OF REFERENCE NUMERALS

1 dust conveyor line
1*a* slurry line
2 oxygen line
3 gasification chamber
4 cooling screen
5 crude gas and slag discharge opening
6 quenching chamber
7 quenching water injection
8 slag discharge
9 hood having nozzles
10 washing water injection nozzle
11 crude gas discharge
12 washing column
13 water bath
14 Venturi washer 1
15 Venturi washer 2
16 washing water
17 washing water separator
18 high-pressure atomization of washing water before partial condenser 19
19 partial condenser
20 high-pressure atomization of washing water after partial condenser 19
21 separation column
22 plate column
23 coated demister
24 gas discharge
25 carbon black water discharge
26 condensate and washing water discharge
27 droplet separator as demister

What is claimed:

1. A multistage crude gas washing apparatus for an entrained flow gasification plant comprising:

an entrained gas flow gasification chamber configured to operate at pressures up to 10 MPa and temperatures up to 1900° C. to produce a crude gas;

a first crude gas washing stage having a quenching chamber connected downstream of the gasification chamber and configured to coarsely purify the crude gas generated in the gasification chamber, the first stage including injecting devices configured to inject water into the crude gas, cool the crude gas to a temperature between 150 and 250° C., and saturate the crude gas with water vapor;

a washing column located downstream of the quenching chamber, the washing column having a bottom part having a water bath, the washing column configured to cause the crude gas to flow through the water bath as a bubble column;

a second crude gas washing stage located downstream of the washing column, the second crude gas washing stage including at least one Venturi washer for the crude gas and a washing water separator located downstream of the at least one Venturi washer and configured to separate washing water from the crude gas flow;

a third crude gas washing stage located downstream of the water separator, the third crude gas washing stage having a high-pressure injection nozzle configured to inject finely-dispersed washing water that is free of solid material into the crude gas; and a demister located within the third crude gas washing stage.

2. The crude gas washing system as claimed in claim 1, wherein the demister comprises a droplet separator.

3. The crude gas washing system as claimed in claim 2, further comprising a separation column following the droplet separator in the path of the washed crude gas, the separation column having a plate column and a demister which are both arranged after the droplet separator.

4. The crude gas washing system as claimed in claim 3, wherein the droplet separator includes washing surfaces therein.

5. The crude gas washing system as claimed in claim 1, further comprising:

a partial condenser after the high-pressure injection nozzle in the path of the crude gas, a further high-pressure injection nozzle following the condenser in the path of the crude gas and configured for finely-dispersed injection of solids-free washing water into the crude gas; and a separation column following the further high-pressure injection nozzle in the path of the crude gas, the separation column having a plate column therein; and, a separate demister in the plate column.

6. The crude gas washing system as claimed in claim 1, wherein the high-pressure injection nozzle of the third crude gas washing stage is supplied with water and is configured to inject water in quantities and temperatures selected such that the crude gas experiences a cooling of 1 to 15° C.

7. The crude gas washing system as claimed in claim 6, further comprising a discharge for crude gas from the quencher;

a hood positioned and configured for covering the crude gas discharge from the quencher;

and water spraying nozzles in the quencher under the hood.

8. The crude gas washing system as claimed in claim 7, further comprising a partition wall protruding from below into a volume in the quencher enclosed by the hood.

9. The crude gas washing system as claimed in claim 7, wherein the hood extends around an entire circumference of the quencher.

10. The crude gas washing system as claimed in claim 1, wherein the at least one Venturi washer includes a throat which is variable.

11. The crude gas washing system as claimed in claim 1, further comprising a further injection nozzle configured for receiving and injecting washing water such that the washing water is injected into the path of the crude gas between the crude gas discharge from the quencher and the washing column.

12. The crude gas washing system as claimed in claim 1, wherein the system is configured to separate carbon black from the entrained flow and into water, and configured so that discharge condensate from the crude gas and the carbon black water are supplied again to the washing stages after processing in the system.

13. The crude gas washing system as claimed in claim 1, wherein the demister is coated with PTFE.

14. The crude gas washing system as claimed in claim 1, wherein the demister is coated with a Teflon compound.

* * * * *